US006983728B1

(12) United States Patent
Banks, Jr. et al.

(10) Patent No.: US 6,983,728 B1
(45) Date of Patent: Jan. 10, 2006

(54) SKID STEER LOADER INCLUDING MUFFLER SUPPORT FOR ENGINE

(75) Inventors: Clayton E Banks, Jr., Brownstown, PA (US); Braden G Cammauf, Lititz, PA (US); Brian R Doutrich, New Holland, PA (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 10/909,654

(22) Filed: Aug. 2, 2004

(51) Int. Cl.
*F02B 77/00* (2006.01)
*F01N 7/00* (2006.01)

(52) U.S. Cl. ..... 123/198 R; 60/322

(58) Field of Classification Search ..... 123/198 R; 60/322; 180/309; 248/300, 674
See application file for complete search history.

(56) References Cited

U.S. PATENT DOCUMENTS

| | | | | |
|---|---|---|---|---|
| 4,060,143 | A | | 11/1977 | Matsumoto et al. |
| 4,339,919 | A | * | 7/1982 | Jobling et al. ..... 60/322 |
| 5,042,602 | A | * | 8/1991 | Nakatani et al. ..... 180/68.1 |
| 5,197,698 | A | | 3/1993 | Bartholomew |
| 5,832,726 | A | | 11/1998 | Rees et al. |
| 6,095,460 | A | | 8/2000 | Mercer et al. |
| 6,164,062 | A | | 12/2000 | Blichmann |
| 6,371,238 | B1 | | 4/2002 | Svihla |
| 6,412,586 | B1 | | 7/2002 | Askew |
| 2004/0000624 | A1 | | 1/2004 | Blaisdell et al. |
| 2004/0060763 | A1 | | 4/2004 | Stodolka |

FOREIGN PATENT DOCUMENTS

EP 546379 A1 6/1993

* cited by examiner

*Primary Examiner*—Noah P. Kamen
(74) *Attorney, Agent, or Firm*—John William Stader

(57) ABSTRACT

The muffler and support according to the preferred embodiment is for use with an engine for a skid steer loader, and has a natural frequency that is outside the vibration frequency of the engine.

7 Claims, 4 Drawing Sheets

SKID STEER LOADER INCLUDING MUFFLER SUPPORT FOR ENGINE

BACKGROUND OF THE INVENTION

1. Field of the Invention

The present invention is directed to a skid steer loader, and in particular, a skid steer loader including a muffler support for an engine.

2. Description of the Background Art

FIG. 1 shows a conventional, internal-combustion engine 1 for a skid steer loader. The engine 1 includes an exhaust manifold (not shown) and a muffler 5 connected to the manifold via an exhaust pipe (not shown). A turbocharger may be interposed between the muffler 5 and the exhaust manifold.

As shown in FIG. 2, the muffler 5 includes an intake pipe 7, an outflow pipe 9 and first and second bracket supports 19, 21, which are blade-like projections from the body of the muffler. First and second brackets 11, 13 are coupled to the respective first and second bracket supports 19, 21 by such known fasteners as rivets, welds (e.g., spot welds), adhesive or nuts and bolts.

The first bracket 11 and the second bracket 13 each comprises stamped metal. The first bracket comprises an L-shaped longitudinal member 15 and a foot 17 that is generally perpendicular to the longitudinal member 15. The second bracket comprises an S-shaped member 23 (i.e., consisting of a pair of planar, offset plates joined by a curved section) and a generally perpendicularly extending foot 25. As shown in FIG. 1, the feet 17, 25 of the first and second bracket are bolted to the engine block or some other structural member of the engine 1. Also, the intake pipe 7 is bolted to a turbocharger or the exhaust pipe.

A problem arises when the above-described bracket members according to the prior art are used to support a muffler. The engine 1 vibrates within known frequencies as it runs. The vibrations are, in effect, high-frequency, low-amplitude, multi-directional accelerations imparted to the muffler through the brackets. As the relatively heavy muffler is accelerated multi-directionally, moments and forces are applied to the brackets and fatigue the brackets. Furthermore, the natural frequency of the muffler-bracket system of the prior art device is within the known vibration frequency of the engine; and as a result the muffler-bracket system resonates at its natural frequency. The prior art muffler-bracket system has been known to fail within a few hours because of vibration of the engine.

In light of the foregoing deficiencies of the prior art, the technical aspects of which the inventors discovered, there is a need for a muffler bracket for an engine of a skid steer loader that will extend the time until first servicing appointment is required. That is, there is a need for a muffler bracket that will last longer than the prior art bracket.

SUMMARY OF THE INVENTION

According to an aspect of the invention, an engine comprises an engine block, a muffler and a bracket interconnecting the muffler and engine block, and the bracket has a natural frequency outside of the operating range of the engine.

According to another aspect of the invention, a skid steer loader comprises an internal-combustion engine; a muffler; and at least four rods interconnecting the muffler and the engine. A pair of the four rods interconnect one side of the engine and one side of the muffler and the pair of rods is disposed in substantially the same plane, and each of the four rods has a circular cross section.

DETAILED DESCRIPTION OF THE PREFERRED EMBODIMENT

The muffler and support according to the preferred embodiment is for use with an engine for a skid steer loader, and has a natural frequency that is outside the vibration frequency of the engine. Moreover, the supports according to the preferred embodiment are capable of lasting much longer than the stamped bracket of the prior art.

Figure 1:
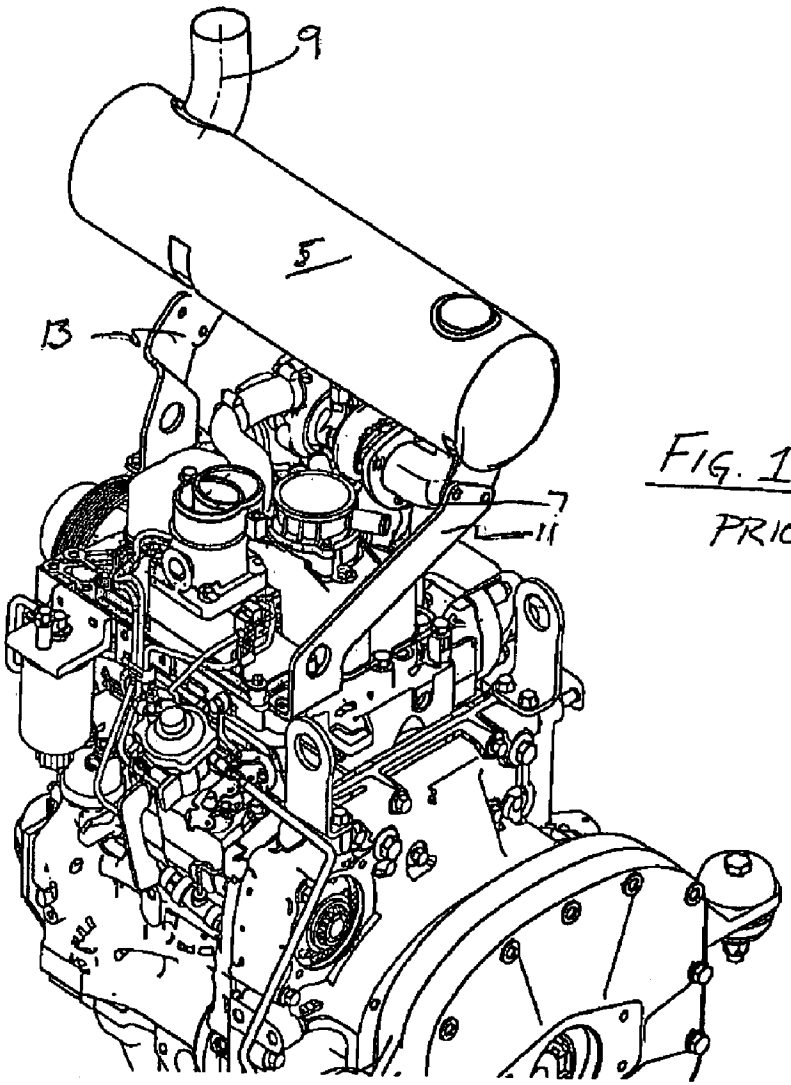
FIG. 1 PRIOR ART
FIG. 1 shows a conventional engine, including a muffler and brackets.
Figure 2:
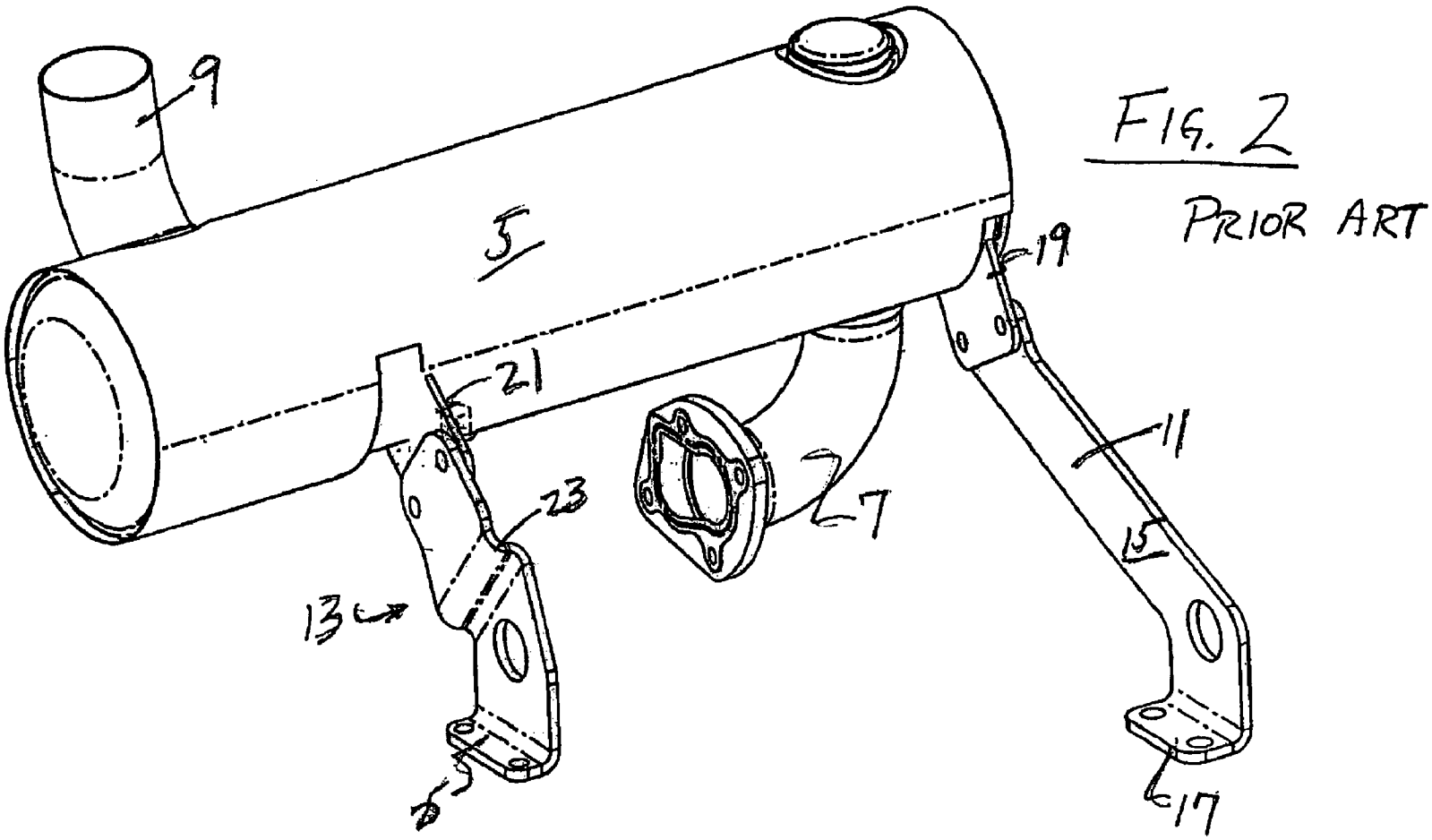
FIG. 2 PRIOR ART
FIG. 2 shows a conventional muffler and brackets.
Figure 3:
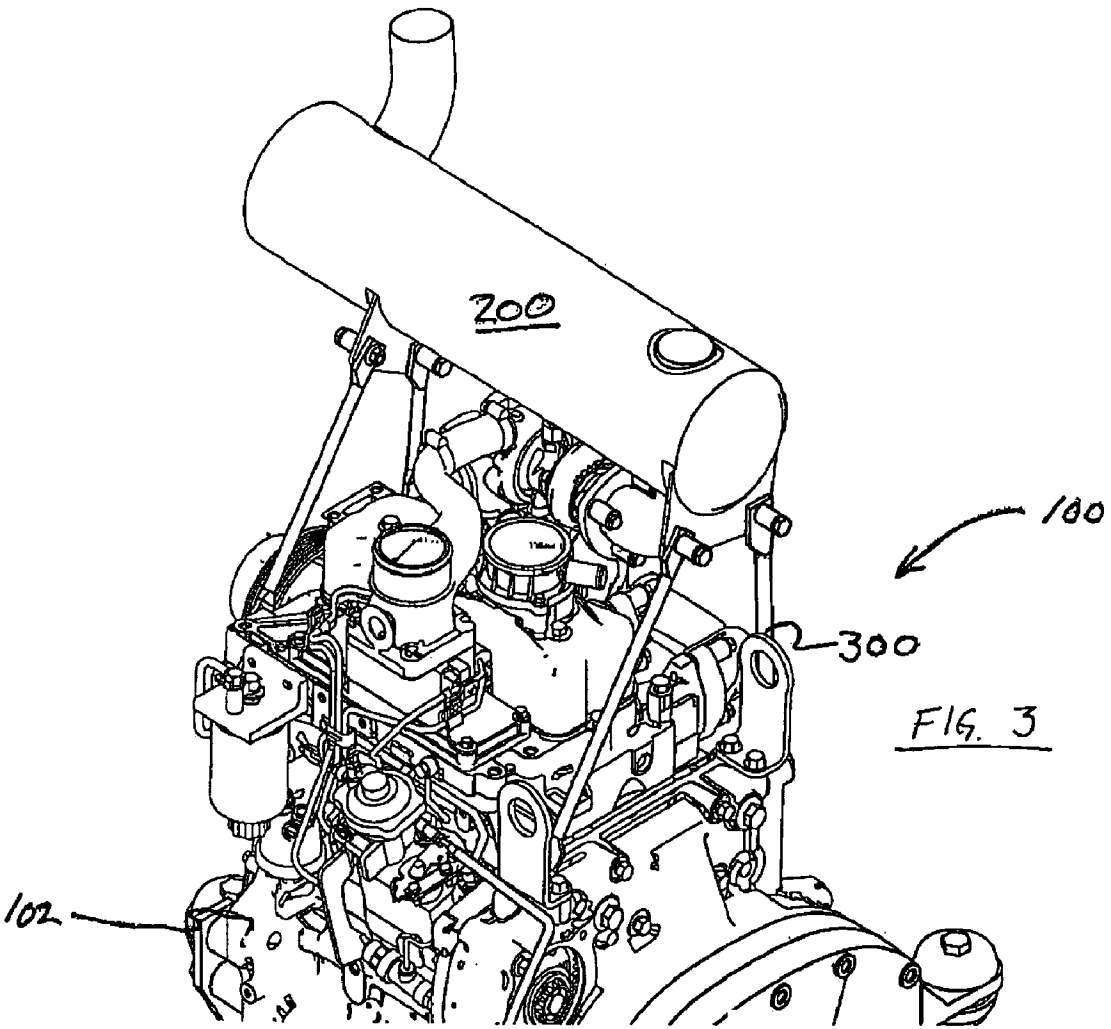
FIG. 3 shows an engine, including a muffler and brackets according to a preferred embodiment of the invention.

FIG. 3 shows a conventional engine 100 for a skid steer loader. The engine 100 comprises an engine block 102. The engine 100 is a conventional internal-combustion comprising anywhere from one to four cylinders, typically in a line but the cylinders may also be disposed in V formation. The engine 100 has a longitudinal axis, which corresponds to the axis of the crankshaft (not shown). The engine 100 generates vibration when it is running, and that vibration generally comprises lateral motion or rotational motion about the longitudinal axis of the engine. Longitudinal motion (where the engine moves fore and aft along its longitudinal axis) is negligible.

The skid steer loader that the engine 100 is used in is of a conventional type in all respects other than those mentioned herein, including the frame layout, drive system, hydraulic system and boom architecture. A conventional skid steer loader is disclosed in U.S. Pat. No. 4,168,757, which is expressly incorporated herein by reference.

Figure 4:
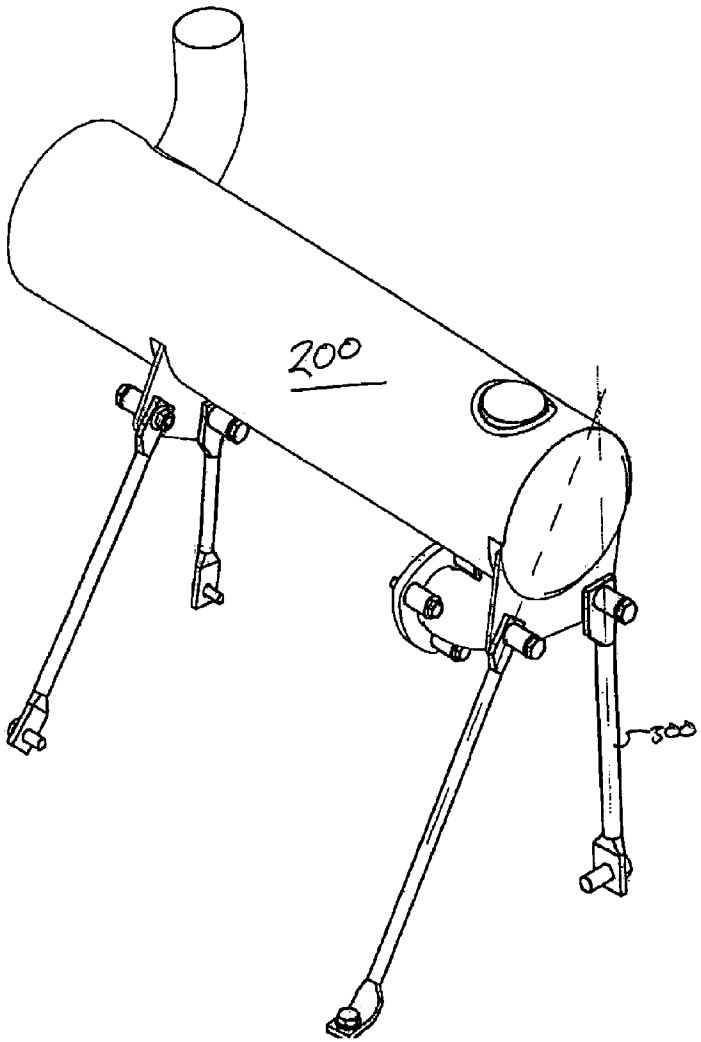
FIG. 4 shows a muffler and brackets according to the preferred embodiment of the invention.

A muffler 200 is coupled to the engine block or another structural member of the engine, preferably by four supports 300. As best seen in FIG. 4, each of the four supports 300 is in the form of a rod. That is, each support has a generally circular cross section. Preferably, each rod is steel, although other metals may be used, such as aluminum and iron. Indeed, it may be possible even to use plastic supports.

The front pair of supports are arranged relative to the engine block or other engine structure and the muffler so as the be at an angle with respect to each other. Thus, as shown in FIG. 4, the front pair of supports are angled so that, were an imaginary line extended along their longitudinal axes, the lines would intersect at some point either within the body of the muffler or outside and above it (the latter case is shown in FIG. 4). The rear pair of supports are arranged similarly.

As a result of this arrangement, each of the supports always experience either tension or compression while the engine is running. In other words, the vibration of the engine tends to cause substantially only simple compression or tension, without bending moments that tend to bend or twist the supports. In addition, the natural frequency of the muffler-support system is increased beyond the operating range of the engine.

Finally, the supports according to the preferred embodiment require less manufacturing steps to produce, and are therefore less expensive than the prior art, stamped brackets.

We claim:

1. A skid steer loader comprising:

an internal-combustion engine;

a muffler; and at least four straight rods interconnecting the muffler and the engine, wherein a pair of the four rods interconnect one side of the engine and one side of the muffler, and each of the four rods has a circular cross section.

2. The skid steer loader according to claim 1, wherein the rods comprise metal.

3. The skid steer loader according to claim 2, wherein the metal is steel.

4. The skid steer loader according to claim 1, wherein another pair of the four rods interconnect another side of the engine and another side of the muffler.

5. The skid steer loader according to claim 1, wherein the pair of rods are disposed at an angle with respect to each other such that imaginary lines extending along the longitudinal axes of each of the pair of rods intersect outside of the muffler.

6. The skid steer loader according to claim 1, each of the four rods including an engine end and a muffler end, the engine end being attached at an engine point to the engine and the muffler end being attached at a muffler point to the muffler, wherein the engine points and the muffler points for each of the four rods are disposed such that the natural frequency of the muffler and four rods is greater than a predetermined frequency.

7. The skid steer loader according to claim 6, wherein the predetermined frequency is the highest operating frequency of the engine.

* * * * *